US008079178B2

(12) United States Patent
Lin

(10) Patent No.: US 8,079,178 B2
(45) **Date of Patent: *Dec. 20, 2011**

(54) MULLION ASSEMBLY FOR DOUBLE DOOR

(75) Inventor: Chung-Liang Lin, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 247 days.

This patent is subject to a terminal disclaimer.

(21) Appl. No.: 12/628,265

(22) Filed: Dec. 1, 2009

(65) Prior Publication Data

US 2011/0126468 A1 Jun. 2, 2011

(51) Int. Cl.
*E06B 5/00* (2006.01)

(52) U.S. Cl. ..... 49/365

(58) Field of Classification Search ..... 49/1, 7, 49/394, 395, 365; 52/204.1, 206
See application file for complete search history.

(56) References Cited

U.S. PATENT DOCUMENTS 5,435,102 A * 7/1995 McCarthy ..... 49/365
5,450,697 A * 9/1995 Prucinsky et al. ..... 52/210
5,471,792 A * 12/1995 Higgins et al. ..... 49/365
5,765,309 A * 6/1998 Mamchych ..... 49/365
5,794,382 A 8/1998 Prucinsky ..... 49/365
5,890,319 A * 4/1999 Haeck et al. ..... 49/365
5,941,023 A * 8/1999 Mamchych ..... 49/365
6,131,338 A * 10/2000 Haeck et al. ..... 49/365
6,427,387 B1 * 8/2002 Hunt ..... 49/365
7,000,355 B2 * 2/2006 Flory et al. ..... 49/365
7,905,058 B2 * 3/2011 Massey et al. ..... 49/365

* cited by examiner

*Primary Examiner* — Jerry Redman
(74) *Attorney, Agent, or Firm* — Alan Kamrath; Kamrath IP Lawfirm PA

(57) ABSTRACT

A mullion assembly (10) includes a top mounting block (92) attached to a top beam (24) of a door frame (22) and having a positioning rod (128) extending in a horizontal direction. A bottom mounting block (132) is mounted on a floor (20) and spaced from the top mounting block (92) in a vertical direction. A post (40) is detachably mounted between top and bottom mounting blocks (92, 132). A brace (50) is mounted to an upper end (42) of the post (40). A mounting bracket (140) is mounted to the brace (50). A pivotal plate (180) is pivotably mounted to the mounting bracket (140) and detachably engaged with the positioning rod (128). A retaining member (198) is mounted to the mounting bracket (140) to lock the post (40) between the top and bottom mounting blocks (92, 132).

15 Claims, 12 Drawing Sheets

MULLION ASSEMBLY FOR DOUBLE DOOR

BACKGROUND OF THE INVENTION

The present invention relates to a mullion assembly and, more particularly, to a mullion assembly for a double door mounted in a double doorway.

It is usual to mount a mullion assembly in a double doorway for engaging with two latches of two doors (or known as a double door) pivotably mounted on opposite sides of a door frame. Conventionally, the mullion assembly includes a mullion tube mounted between the top of the door frame and a floor by fasteners. Removal of the post of the mullion assembly is time-consuming when a full door opening is desired for unobstructed pass purposes due to a need for unscrewing the fasteners. Thus, a key controlled positioning device has been proposed for locking the mullion tube between the top of the door frame and the floor, allowing easy removal of the mullion tube by operation of a key. The key controlled positioning device generally includes a positioning bolt biased by a spring and moveable between a locking position engaged with the top of the door frame and an unlocking position disengaged from the top of the door frame. However, it is sometimes difficult to mount the mullion tube between the door frame and the floor. Specifically, the positioning bolt biased by the spring will contact or even impact the top of the door frame during installation of mullion tube when a key is not utilized to draw the positioning bolt back to the unlocking position, which may cause malfunctioning of both of the positioning bolt and the spring. However, it is inconvenient to use a key to draw the positioning bolt back to the unlocking position while mounting the mullion tube between the door frame and the floor.

Thus, a need exists for a mullion assembly with a removable post that can be easily assembled and installed.

BRIEF SUMMARY OF THE INVENTION

The present invention solves this need and other problems in the field of mullion assemblies for a double door mounted in a double doorway by providing, in a preferred form, a mullion assembly including a top mounting block adapted to be attached to a top beam of a door frame that includes two opposite side beams to which two doors of the double door are pivotably mounted. Each door includes a door lock having a latch. The top mounting block includes a positioning rod extending in a horizontal direction. The mullion assembly further includes a bottom mounting block adapted to be mounted on a floor and spaced from the top mounting block in a vertical direction perpendicular to the horizontal direction. The mullion assembly further includes a post having two strikes adapted to respectively couple with the latches of the door locks when the doors are in a closed state. The post includes upper and lower ends spaced in the vertical direction. The lower end of the post is detachably engaged with the bottom mounting block. A brace is mounted to the upper end of the post. A mounting bracket is mounted to the brace. A pivotal plate is pivotably mounted to the mounting bracket and includes a coupling slot such that the positioning rod is removably received in the coupling slot of the pivotal plate. The pivotal plate is rotatable relative to the mounting bracket between a first position and a second position about a first pivot axis perpendicular to the vertical direction. The pivotal plate is rotatable in a first direction and not rotatable in a second direction reverse to the first direction when the pivotal plate is in the first position. A retaining member is rotatably mounted to the mounting bracket about a second pivot axis perpendicular to the vertical direction and spaced from the first pivot axis in the vertical direction. The retaining member includes a locking portion and an engaging portion. The locking portion of the retaining member is moveable between a locking position engaged with the pivotal plate and an unlocking position disengaged from the pivotal plate. The retaining member is rotatable in the second direction and not rotatable in the first direction when the locking portion of the retaining member is in the locking position. A stop extends through the mounting bracket in the horizontal direction. The stop abuts against the retaining member to stop the retaining member from rotating in the first direction when the locking portion of the retaining member is in the locking position. A key cylinder is mounted to the brace and includes a key-operable actuating member. The actuating member is operably connected to the engaging portion of the retaining member to move the retaining member between the locking position and the unlocking position. When the pivotal plate is in the first position and the locking portion of the retaining member is in the locking position, the pivotal plate is not rotatable in either of the first and second directions from the first position to the second position, locking the post between the top and bottom mounting blocks. When the pivotal plate is in the first position and the locking portion of the retaining member is in the unlocking position, the pivotal plate is rotatable in the first direction from the first position to the second position, allowing removal of the post from the top and bottom mounting blocks.

In the most preferred form, when the pivotal plate is in the first position, the pivotal plate abuts against the brace, and the coupling slot of the pivotal plate substantially extends in the vertical direction. On the other end, when the pivotal plate is in the second position, the pivotal plate abuts the mounting bracket and is spaced from the brace, and the coupling slot of the pivotal plate is at an acute angle to the vertical direction.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where:

FIG. 6*a* shows an enlarged view of a circled portion of FIG. 6.

FIG. 6*b* shows an enlarged view of another circled portion of FIG. 6.

Figure 1:
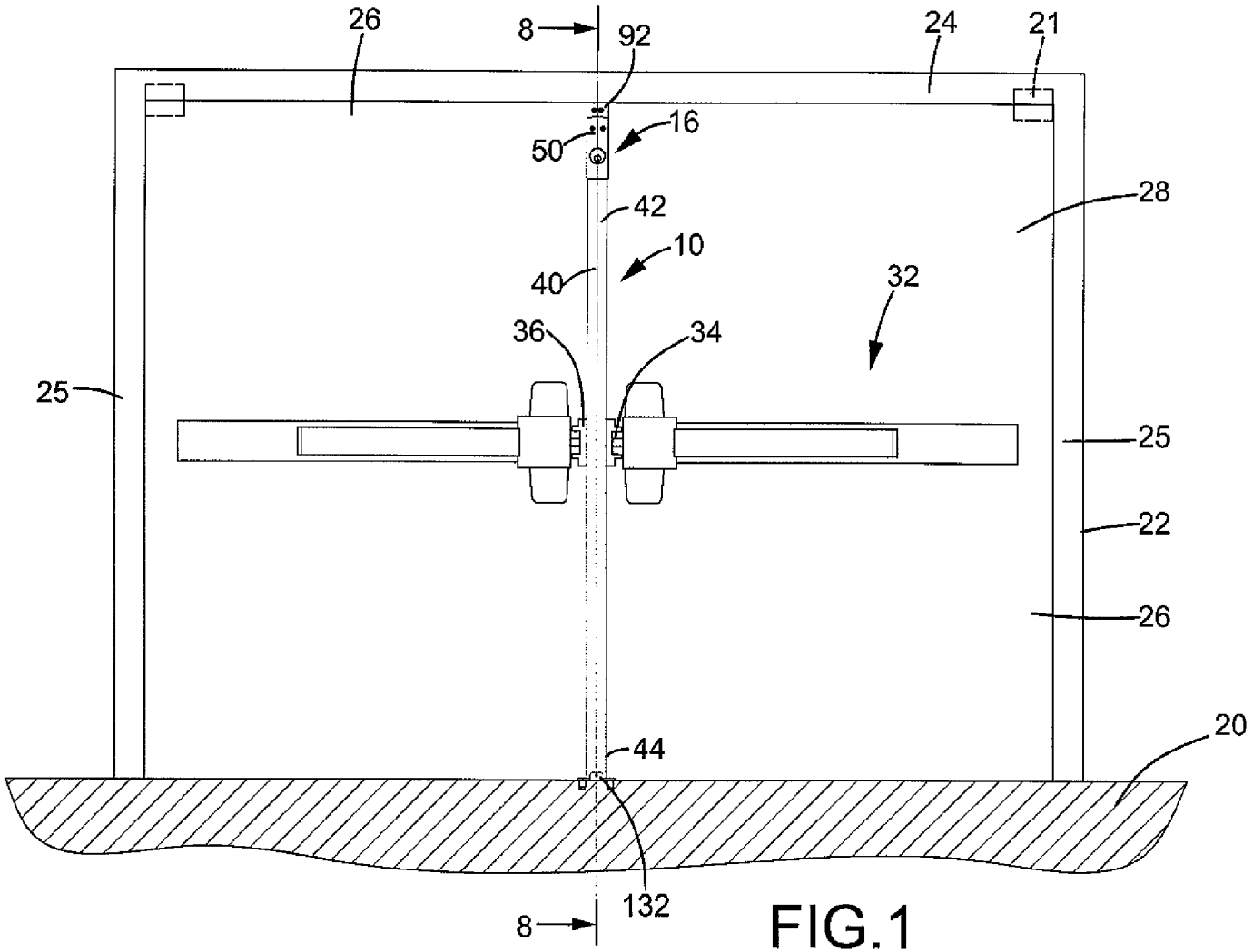
FIG. 1 shows a schematic front view of a mullion assembly according to the preferred teachings of the present invention and a double door to which the mullion assembly is mounted.
Figure 2:
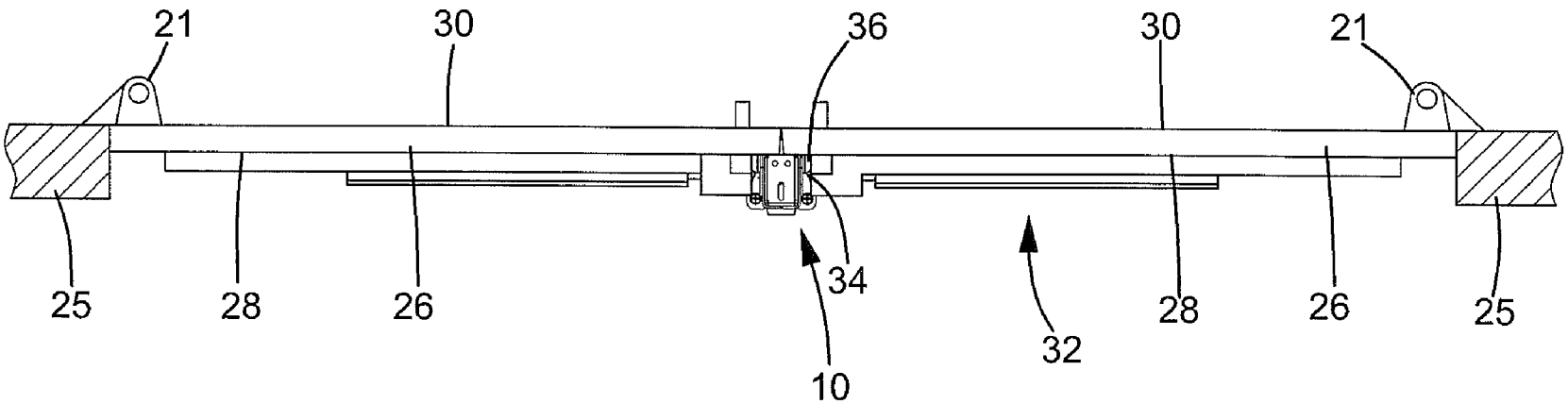
FIG. 2 is a top view of the mullion assembly and the double door of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "side", "end", "portion", "top", "bottom", "annular", "vertical" "horizontal", "width", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A mullion assembly according to the preferred teachings of the present invention is shown in the drawings and generally designated 10. According to the preferred form shown, mullion assembly 10 is mounted in a door frame 22 for a double door mounted in a double doorway. Door frame 22 includes a top beam 24 spaced from a floor 20 in a vertical direction. Door frame 22 further includes two opposite side beams 25 interconnected by top beam 24 and spaced in a horizontal direction perpendicular to the vertical direction. The double door includes first and second doors 26 respectively and pivotably mounted by pivots 21 to side beams 25 of door frame 22 and each including inner and outer faces 28 and 30. Each door 26 further includes a door lock 32 having a latch 34 on an end thereof.

According to the preferred form shown, mullion assembly 10 includes a top mounting block 92. Top mounting block 92 includes an upper cover 94, an outer housing 106, an inner housing 120, and a positioning rod 128. Upper cover 94 includes a top wall 96 and four sides 102 extending downward in the vertical direction from a periphery of top wall 96. Top wall 96 includes two locking holes 98 and a slot 100. A screw 110 is extended through each of locking holes 98 and slot 100 to attach top mounting block 92 to top beam 24 of door frame 22 (see FIG. 8). Each side 102 of upper cover 94 includes a plurality of screw holes 104. Outer housing 106 includes two side plates 108 spaced in the horizontal direction and an interconnecting plate 111 interconnecting side plates 108. A receiving space 113 is defined between side plates 108 and interconnecting plate 111 of outer housing 106. An opening 116 is formed in a lower end of interconnecting plate 111 and defined by two first abutting edges 118 respectively of side plates 108. A plurality of through-holes 112 are provided in side plates 108 and interconnecting plate 111 and aligned with screw holes 104 of top wall 96. A screw 119 is extended through each of through-holes 112 and into one of screw holes 104 to secure outer housing 106 around four sides 102 of upper cover 94. Each side plate 108 of outer housing 106 further includes two positioning holes 114. Inner housing 120 is received in outer housing 106 and located below upper cover 94 in the vertical direction. Inner housing 120 includes two side walls 122 spaced in the horizontal direction and an upper wall 123 interconnecting side walls 122. Side walls 122 include aligned rod holes 124 extending in the horizontal direction and a plurality of fixing holes 126. A screw 121 is extended through each of positioning holes 114 and into one of fixing holes 126 to secure inner housing 120 in outer housing 106. Positioning rod 128 includes two ends 130 spaced in the horizontal direction and respectively received in rod holes 124 of inner housing 120 so that positioning rod 128 is secured in receiving space 113 of outer housing 106.

Figure 3:
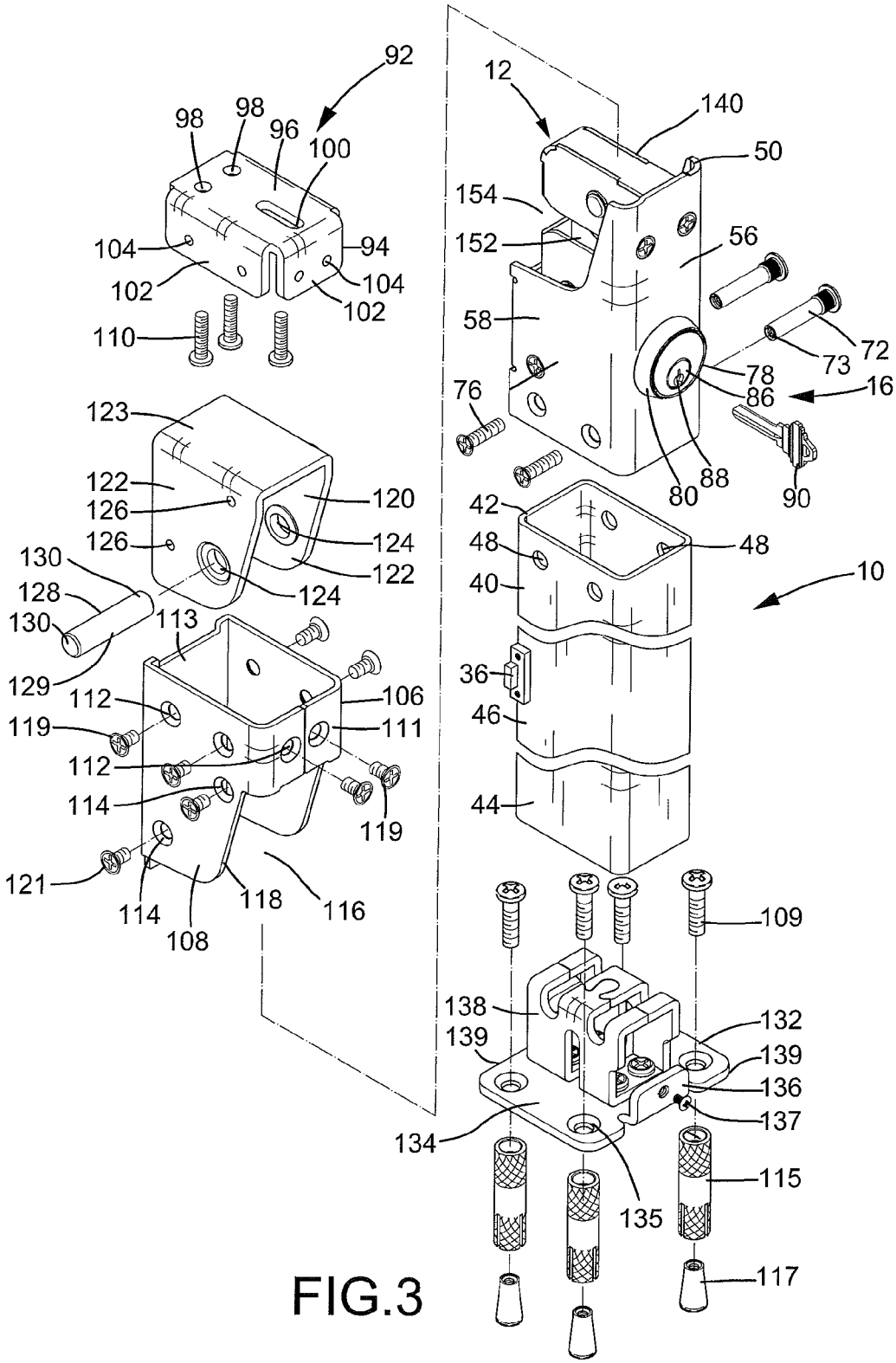
FIG. 3 shows an exploded, perspective view of the mullion assembly of FIG. 1.
Figure 8:
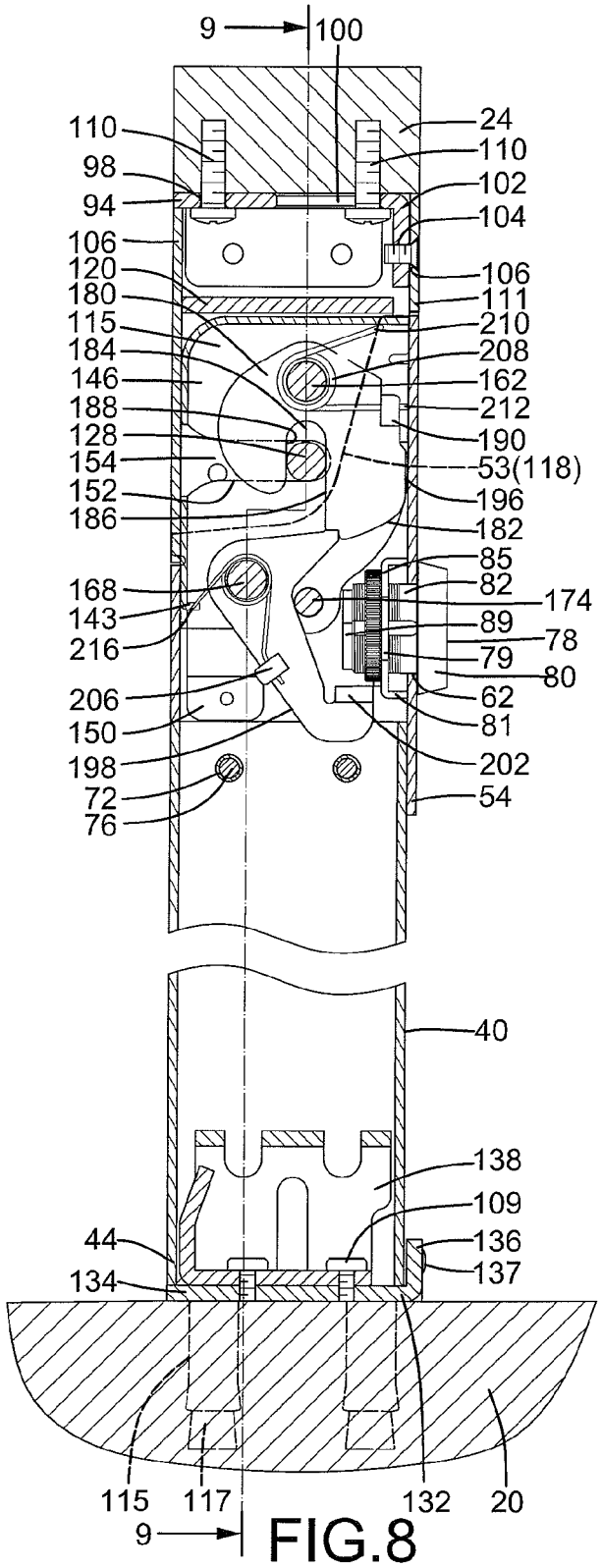
FIG. 8 shows a cross sectional view of the mullion assembly of FIG. 1 taken along section line 8-8 of FIG. 1.
Figure 9:
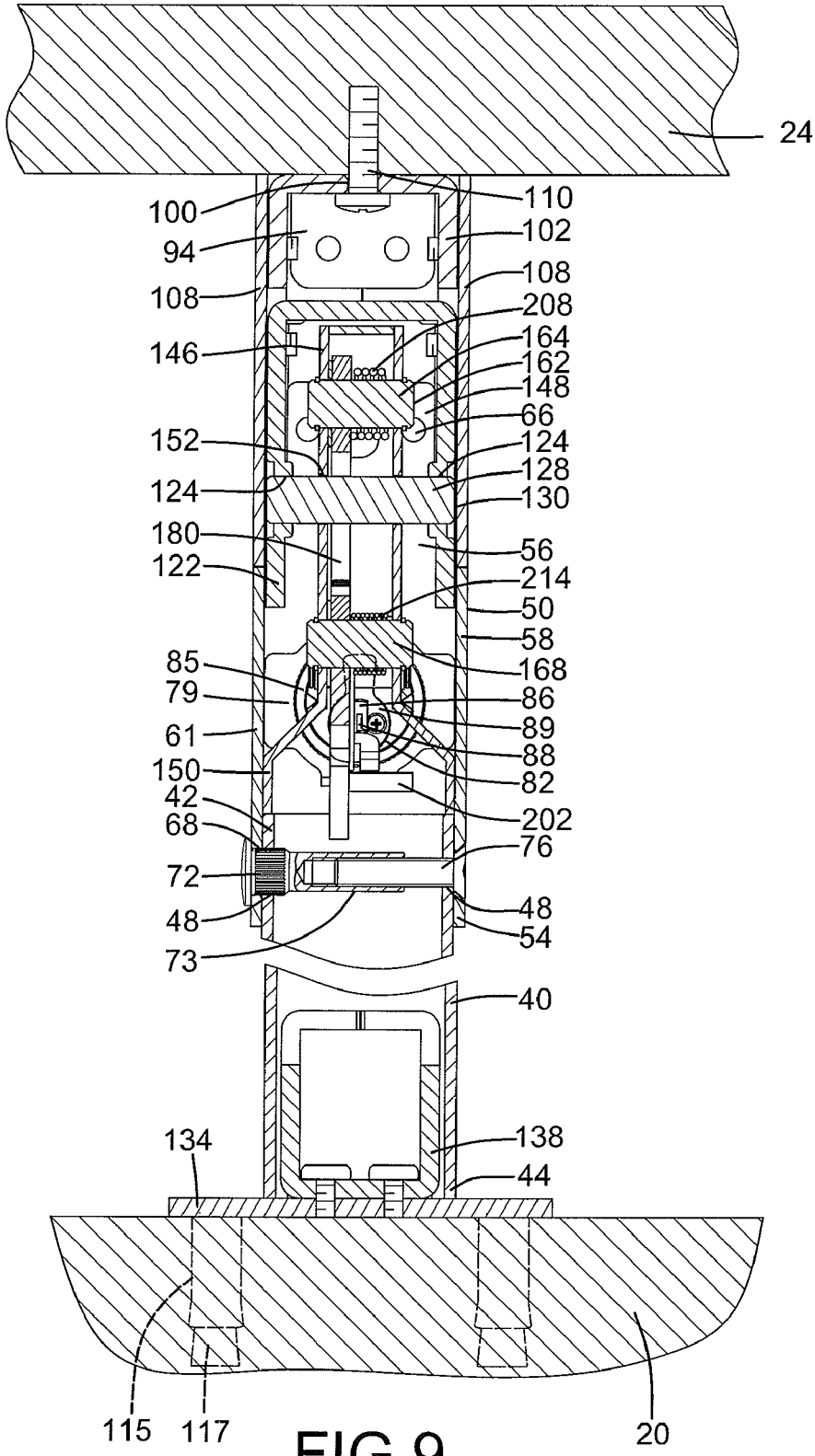
FIG. 9 shows a cross sectional view of the mullion assembly of FIG. 1 taken along section line 9-9 of FIG. 8.

According to the preferred form shown, a bottom mounting block 132 is mounted on floor 20 and aligned with top mounting block 92 in the vertical direction (see FIG. 8). Bottom mounting block 132 includes a base 134 having first and second sides 139 spaced in a width direction perpendicular to the horizontal and vertical directions. A vertical wall 136 extends upward from first side 139 of base 134 in the vertical direction. A coupling block 138 extends upward from base 134 in the vertical direction and between second side 139 of base 134 and vertical wall 136 in the width direction. A plurality of through-holes 135 is provided in and extended through bottom mounting block 132 in the vertical direction. A plurality of sleeves 115 is embedded in floor 20 and respectively aligned with through holes 135 in bottom mounting block 132 in the vertical direction (see FIGS. 3 and 8). Each sleeve 115 includes a tapered nut 117 therein for receiving a screw 109 which extends through one of through-holes 135 in bottom mounting block 132. Sleeves 115 are squeezed by tapered nuts 117 and expand to securely engage in floor 20 when screws 109 are driven into tapered nuts 117 so that bottom mounting block 132 can be attached to floor 20 firmly.

According to the preferred form shown, mullion assembly 10 further includes a post 40 in the most preferred form shown as a hollow tube having annular cross sections. Post 40 includes upper and lower ends 42 and 44 spaced in the vertical direction. Post 40 further includes four sidewalls 46 extending between upper and lower ends 42 and 44. Lower end 44 of post 40 is detachably engaged with bottom mounting block 132 with sidewalls 46 of lower end 44 of post 40 mounted around coupling block 138 of bottom mounting block 132 and resting on base 134 of bottom mounting block 132. Upper end 42 of post 40 includes aligned through-holes 48. Post 40 further includes two strikes 36 respectively coupling with latches 34 of door locks 32 when first and second doors 26 are in a closed state (see FIG. 1).

Figure 6:
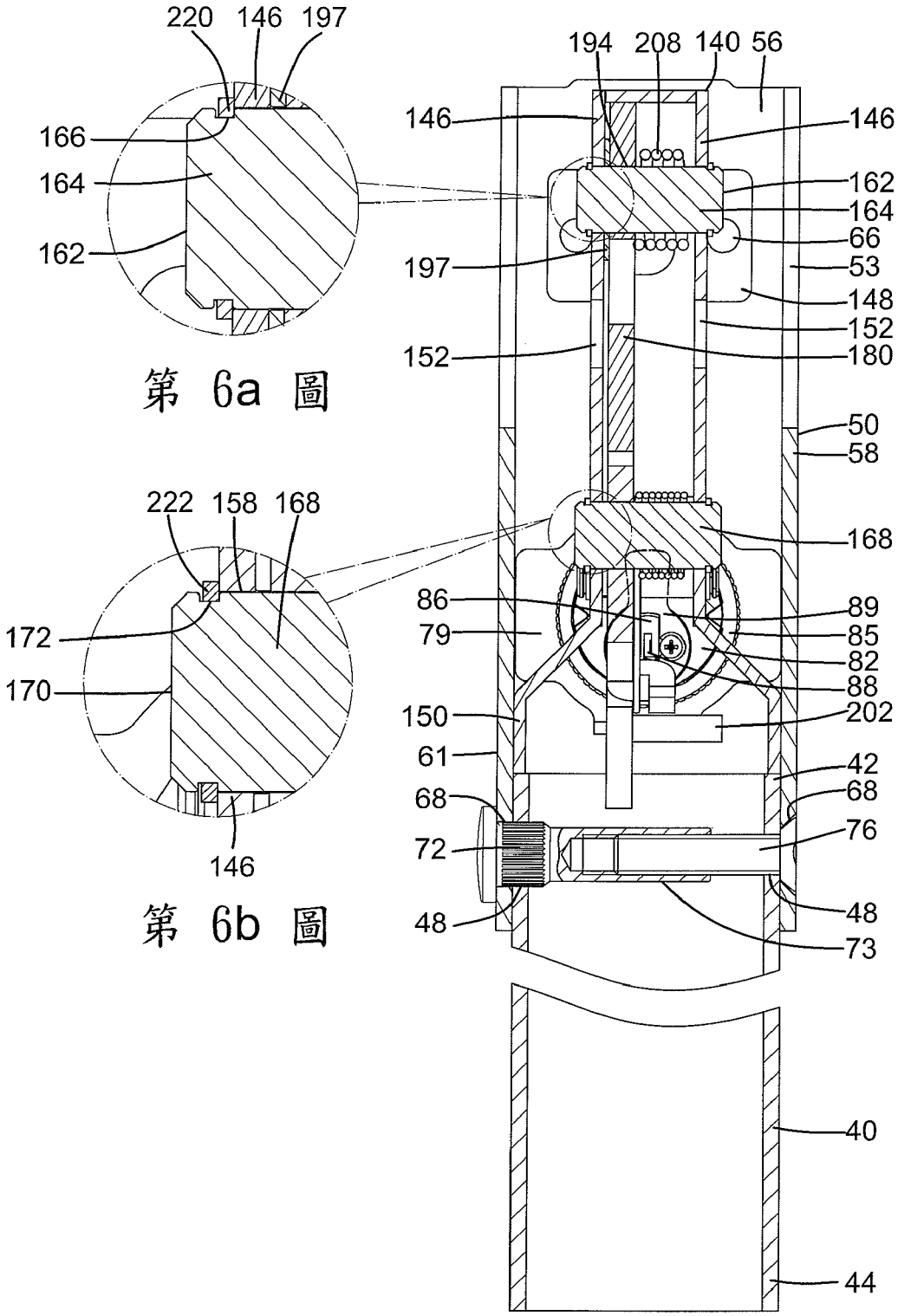
FIG. 6 shows a cross sectional view of a portion of the mullion assembly of FIG. 1 taken along section line 6-6 of FIG. 5.

According to the preferred form shown, mullion assembly 10 further includes a brace 50. Brace 50 includes a first wall 56 and second and third walls 58 and 61 interconnected by first wall 56. Second and third walls 58 and 61 of brace 50 are spaced in the horizontal direction. Brace 50 further includes upper and lower portions 52 and 54 spaced in the vertical direction. Brace 50 further includes an interconnecting wall 59 interconnecting second and third walls 58 and 61 and opposite to first wall 56. A notch 74 is formed in lower end of interconnecting wall 59. Lower portion 54 of each of second and third walls 58 and 61 of brace 50 includes two through-holes 68 aligned with through-holes 48 of upper end 42 of post 40 in the horizontal direction. Two pins 72 respectively extend through through-holes 68 of third wall 61 and through-holes 48 of post 40 and each includes a screw hole 73 in an end thereof (see FIG. 6). A screw 76 extends through each of through-holes 68 of second wall 58 of brace 50 and into screw hole 73 of one of pins 72 to secure lower portion 54 of brace 50 around upper end 42 of post 40, with lower end of interconnecting wall 59 abutting on upper end 42 of post 40. A cut-out 57 is formed in upper portion 52 of brace 50 and defines two second abutting edges 53 each formed on an upper end of one of second and third walls 58 and 61 of brace 50 and complementary to one of first abutting edges 118 of outer housing 106. Further, brace 50 includes a mounting hole 62 in first wall 56, two through-holes 60 in first wall 56 and above mounting hole 62 in the vertical direction, and a fixing hole 64 in each of second and third walls 58 and 61.

Figure 4:
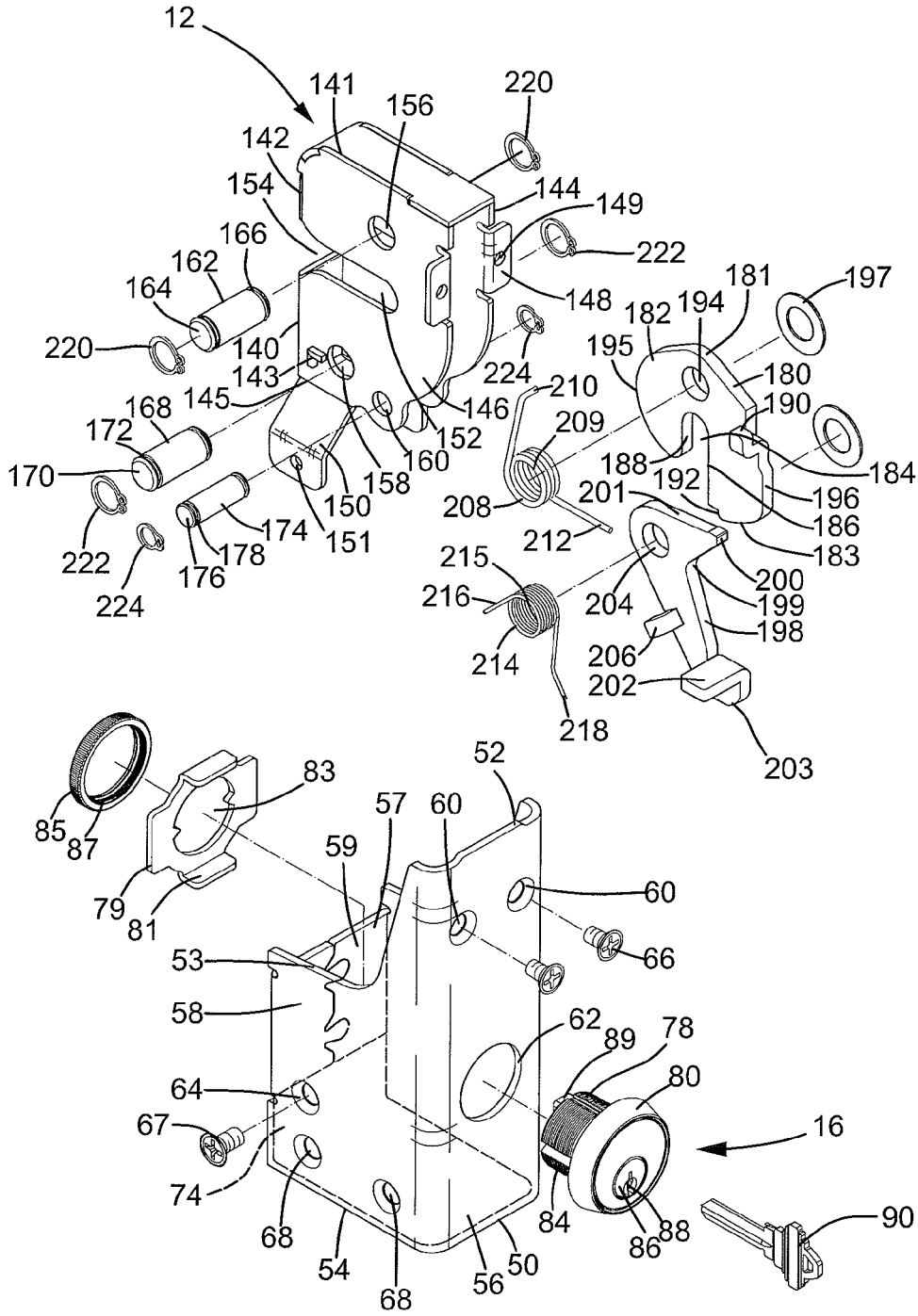
FIG. 4 shows an exploded, perspective view of a positioning device, a brace, and a key cylinder of the mullion assembly of FIG. 1.

According to the preferred form shown, mullion assembly 10 further includes a positioning device 12 that includes a mounting bracket 140, a pivotal plate 180, a retaining member 198, and a stop 174 (see FIG. 4). Mounting bracket 140 is securely mounted in upper portion 52 of brace 50. Mounting bracket 140 is substantially U-shaped in cross section and includes a main wall 142 and two sidewalls 146 interconnected by main wall 142 and spaced in the horizontal direction. Mounting bracket 140 further includes upper and lower ends 141 and 145 spaced in the vertical direction. Sidewalls 146 of mounting bracket 140 includes aligned guiding slots 152 intermediate upper and lower ends 141 and 145 of mounting bracket 140 in the vertical direction and extending in the width direction. Main wall 142 of mounting bracket 140 includes an opening 154 in communication with guiding slots 152 so that positioning rod 128 is removably received in guiding slots 152 of sidewalls 146 of mounting bracket 140 through opening 154 of main wall 142 of mounting bracket 140. Sidewalls 146 of mounting bracket 140 further includes aligned first shaft holes 156 each intermediate one of guiding slots 152 and upper end 141 of mounting bracket 140 in the vertical direction. Sidewalls 146 of mounting bracket 140 further includes aligned first pin holes 158 each intermediate one of guiding slots 152 and lower end 145 of mounting bracket 140 in the vertical direction. An abutting portion 143 is formed on a lower end of main wall 142. A bend 148 with a screw hole 149 is formed on a side end 144 of each sidewall 146. A wing 150 with a screw hole 151 is formed on a lower end of each sidewall 146. Mounting bracket 140 can be securely fixed in upper portion 52 of brace 50 by extending screws 66 through through-holes 60 in first wall 56 of brace 50 into screw holes 149 of bends 148 of mounting bracket 140 and by extending screws 67 through fixing holes 64 in second and third walls 58 and 61 of brace 50 into screw holes 151 of wings 150 of mounting bracket 140. Mounting bracket 140 mounted in brace 50 is received in receiving space 113 of outer housing 106 through opening 116.

Figure 5:
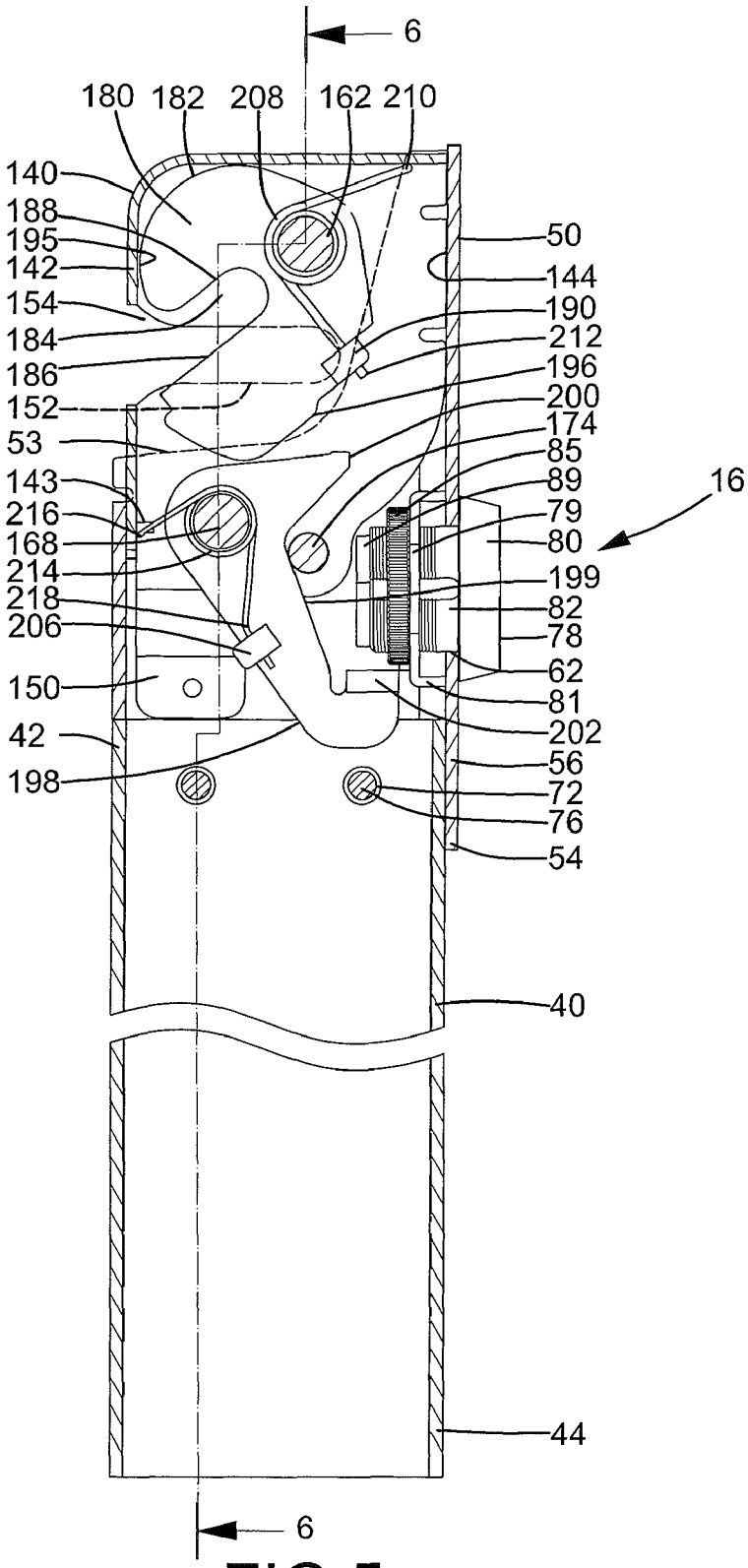
FIG. 5 shows a cross sectional view of the positioning device, the brace, the key cylinder, and a post of the mullion assembly of FIG. 4 after assembly.
Figure 10:
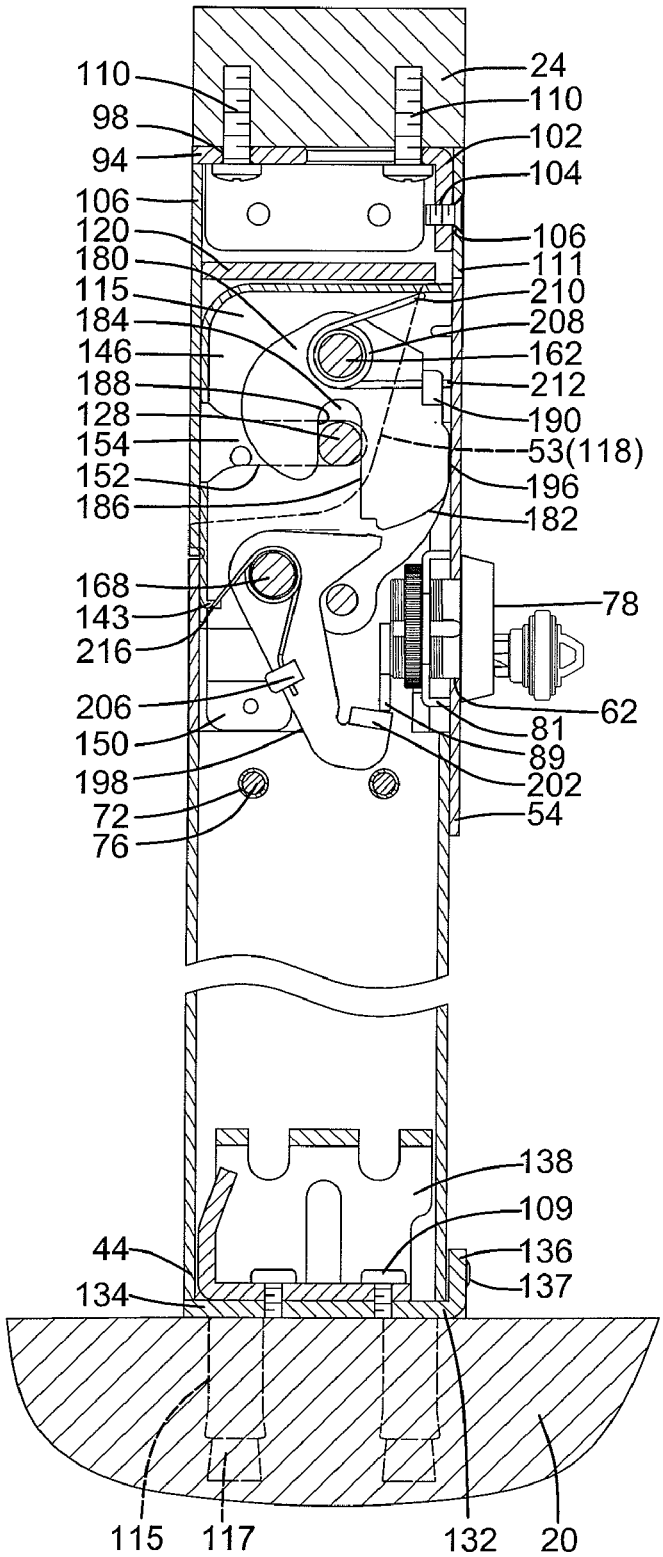
FIG. 10 shows a cross sectional view taken along section line 8-8 of FIG. 1 and similar to FIG. 8, with a retaining member moved downward through activation of a key-operable actuating member.

According to the preferred form shown, pivotal plate 180 is pivotably mounted between sidewalls 146 of mounting bracket 140. Pivotal plate 180 includes upper and lower ends 181 and 183 spaced in the vertical direction. A coupling slot 184 extends from lower end 183 of pivotal plate 180 towards but spaced from upper end 181 of pivotal plate 180 and includes opposite first and second sides 186 and 188. Coupling slot 184 has a length in the vertical direction greater than a diameter of positioning rod 128, and first side 186 has a length in the vertical direction greater than that of second side 188, allowing positioning rod 128 to be received in coupling slot 184 of pivotal plate 180. Pivotal plate 180 further includes a second shaft hole 194 intermediate coupling slot 184 and upper end 181 of pivotal plate 180 in the vertical direction and aligned with first shaft holes 156 of mounting bracket 140. A shaft 162 extends through first shaft holes 156 of mounting bracket 140 and second shaft hole 194 of pivotal plate 180 to allow lower end 183 of pivotal plate 180 to rotate about a first pivot axis defined by shaft 162 between a first position and a second position. Shaft 162 includes an annular groove 166 in each of two ends 164 thereof. A retainer ring 220 such as a C-clip is mounted in each of annular grooves 166 to retain shaft 162 in place. Pivotal plate 180 further includes an outer periphery 182 having first and second abutting faces 196 and 195 between which coupling slot 184 is formed. When pivotal plate 180 is in the first position, first abutting face 196 of pivotal plate 180 abuts against brace 50, and coupling slot 184 of pivotal plate 180 substantially extends in the vertical direction (see FIG. 10). Thus, pivotal plate 180 is rotatable in a first direction (clockwise direction in FIG. 10) and not rotatable in a second direction (counterclockwise direction in FIG. 10) reverse to the first direction when pivotal plate 180 is in the first position. On the other end, when pivotal plate 180 is in the second position, second abutting face 195 of pivotal plate 180 abuts main wall 142 of mounting bracket 140 and spaced from brace 50, and coupling slot 184 of pivotal plate 180 is at an acute angle to the vertical direction and coincident with guiding slots 152 of mounting bracket 140 (see FIG. 5). Thus, pivotal plate 180 is rotatable in the second direction (counterclockwise direction in FIG. 5) and not rotatable in the first direction (clockwise direction in FIG. 5) when pivotal plate 180 is in the second position. A notch 192 is formed in lower end 183 of pivotal plate 180 and adjacent first side 186 of coupling slot 184. A bend 190 is formed on first abutting face 196 of outer periphery 182 of pivotal plate 180. A first torsion spring 208 is mounted between two sidewalls 146 of mounting bracket 140 and includes a coil portion 209 through which shaft 162 extends. First torsion spring 208 further includes first and second tangs 210 and 212 each extending from an end of coil portion 209 and respectively abutting against mounting bracket 140 and bend 190 of pivotal plate 180 to bias pivotal plate 180 from the first position to the second position. A washer 197 is mounted around shaft 162 and between pivotal plate 180 and one of sidewalls 146 of mounting bracket 140 to allow smooth rotation of pivotal plate 180.

According to the preferred form shown, retaining member 198 is rotatably mounted in mounting bracket 140 and located below pivotal plate 180 in the vertical direction. Retaining member 198 includes upper and lower ends 201 and 203 spaced in the vertical direction. A locking portion 200 is formed on upper end 201 of retaining member 198. An engaging portion 202 extends from lower end 203 of retaining member 198 away from locking portion 200 in the horizontal direction. Retaining member 198 further includes a second pin hole 204 aligned with first pin holes 158 of mounting bracket 140. A pin 168 extends through first pin holes 158 of mounting bracket 140 and second pin hole 204 of retaining member 198 to allow retaining member 198 to rotate between a locking position engaged with notch 192 of pivotal plate 180 (see FIG. 8) and an unlocking position disengaged from notch 192 of pivotal plate 180 (see FIG. 10). Pin 168 includes two annular grooves 172 in two outer ends 170 thereof. A retainer ring 222 such as a C-clip is mounted in each of annular grooves 172, preventing displacement of pin 168 in the horizontal direction. In the most preferred form shown, retaining member 198 is substantially V-shaped in cross section and includes an L-shaped side 199 extending between upper and lower ends 201 and 203 thereof. A second torsion spring 214 is mounted between two sidewalls 146 of mounting bracket 140 and includes a coil portion 215 through which pin 168 extends. Second torsion spring 214 further includes first and second tangs 216 and 218 each extending from an end of coil portion 215 of second torsion spring 214 and respectively abutting against abutting portion 143 of mounting bracket 140 and an abutting portion 206 formed on retaining member 198 to bias retaining member 198 from the unlocking position to the locking position.

According to the preferred form shown, stop 174 extends through sidewalls 146 of mounting bracket 140 in the horizontal direction and abuts L-shaped side 199 of retaining member 198. Positioning rod 128 is intermediate shaft 162 and stop 174 in the vertical direction (see FIG. 8). Stop 174 abuts against L-shaped side 199 of retaining member 198 to stop retaining member 198 from rotating in the first direction when locking portion 200 of retaining member 198 is in the locking position. In the most preferred form shown, stop 174 is in the form of a pin and includes two annular grooves 178 in two outer ends 176 thereof. A retainer ring 224 such as a C-clip is mounted in each of annular grooves 178, preventing displacement of stop 174 in the horizontal direction.

According to the preferred form shown, mullion assembly 10 further includes a key cylinder 16 that includes a hollow body 78 having a flange 80 and receiving a lock core 86 which includes a keyway 88. Outer threading 84 is formed on an outer circumference of hollow body 78, allowing key cylinder 16 to be threadedly coupled in mounting hole 62 of first wall 56 of brace 50 with flange 80 abutting first wall 56 of brace 50. A support plate 79 with a mounting hole 83 and a locking ring 85 with a screw hole 87 are received in brace 50 and mounted around hollow body 78 to secure key cylinder 16 in place. Support plate 79 includes two bends 81 spaced in the vertical direction and abutting first wall 56 of brace 50. Support plate 79 further includes two sides spaced in the horizontal direction and abutting second and third walls 58 and 61 of brace 50. An actuating member 89 is mounted on an inner end of lock core 86 and above engaging portion 202 of retaining member 198 in the vertical direction. Actuating member 89 is rotatable by operation of a key 90 inserted into keyway 88 so that actuating member 89 is operably connected to engaging portion 202 of retaining member 198 to move locking portion 200 of retaining member 198 between the locking and unlocking positions.

Figure 7:
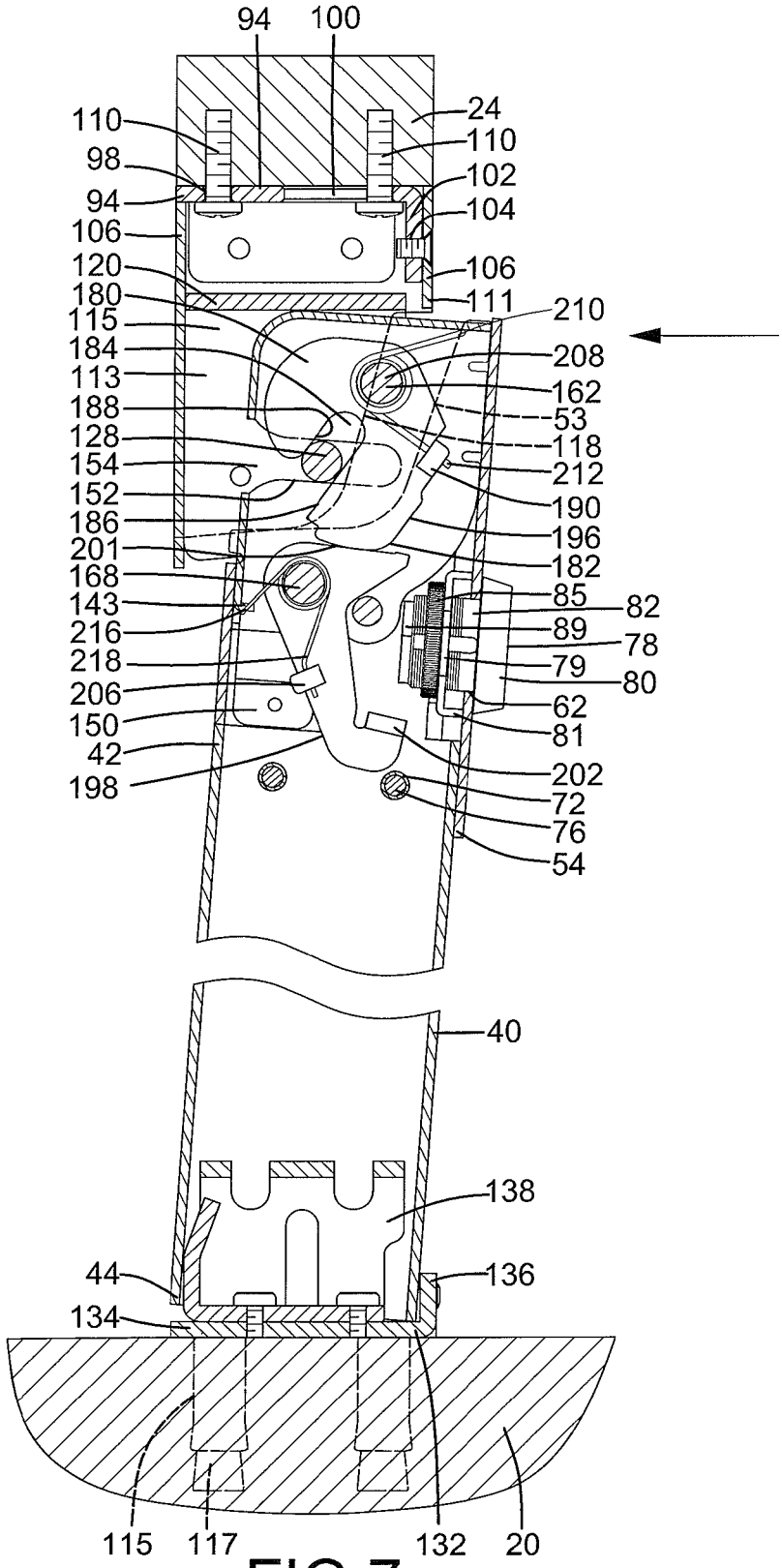
FIG. 7 is a cross sectional view taken along section line 8-8 of FIG. 1, illustrating mounting of the mullion assembly of FIG. 1 to a door frame of the double door.

FIG. 7 illustrates mounting of mullion assembly 10 to door frame 22 in the double doorway. Firstly, top and bottom mounting blocks 92 and 132 are respectively attached to top beam 24 of door frame 22 and floor 20. Next, post 40 with brace 50 fixed thereto is held at an acute angle to floor 20, with lower end 44 of post 40 engaged around coupling block 138 of bottom mounting block 132 and resting on base 134 of bottom mounting block 132, with mounting bracket 140 in upper portion 52 of brace 50 received in receiving space 113 of outer housing 106 of top mounting block 92 through opening 116, with upper end 201 of retaining member 198 abutting against first abutting face 196 of outer periphery 182 of pivotal plate 180, and with positioning rod 128 received in coupling slot 184 of pivotal plate 180. Post 40 is then moved in the horizontal direction and pivoted toward a vertical position at about 90 degrees to floor 20, with positioning rod 128 pressing against first side 186 of coupling slot 184, and with pivotal plate 180 being moved from the second position to the first position and compressing first torsion spring 208. When post 40 reaches the vertical position with second abutting edges 53 of brace 50 abutting first abutting edges 118 of outer housing 106 (see FIG. 8), lower end 44 of post 40 is fittingly engaged around coupling block 138 of bottom mounting block 132, and positioning rod 128 is entirely received in coupling slot 184 of pivotal plate 180. Furthermore, when pivotal plate 180 is moved to the first position, first abutting face 196 of pivotal plate 180 abuts against first wall 56 of brace 50, and locking portion 200 of retaining member 198 moves upward in the vertical direction to the locking position engaged with notch 192 of pivotal plate 180 under the action of second torsion spring 214, allowing post 40 to be locked between top and bottom mounting blocks 92 and 132. Further, a screw 137 can be extended through vertical wall 136 of bottom mounting block 132 and presses against a portion of lower end 44 of post 40 sandwiched between vertical wall 136 and second coupling block 138 of bottom mounting block 132 to provide post 40 with enhanced positioning effect.

Figure 11:
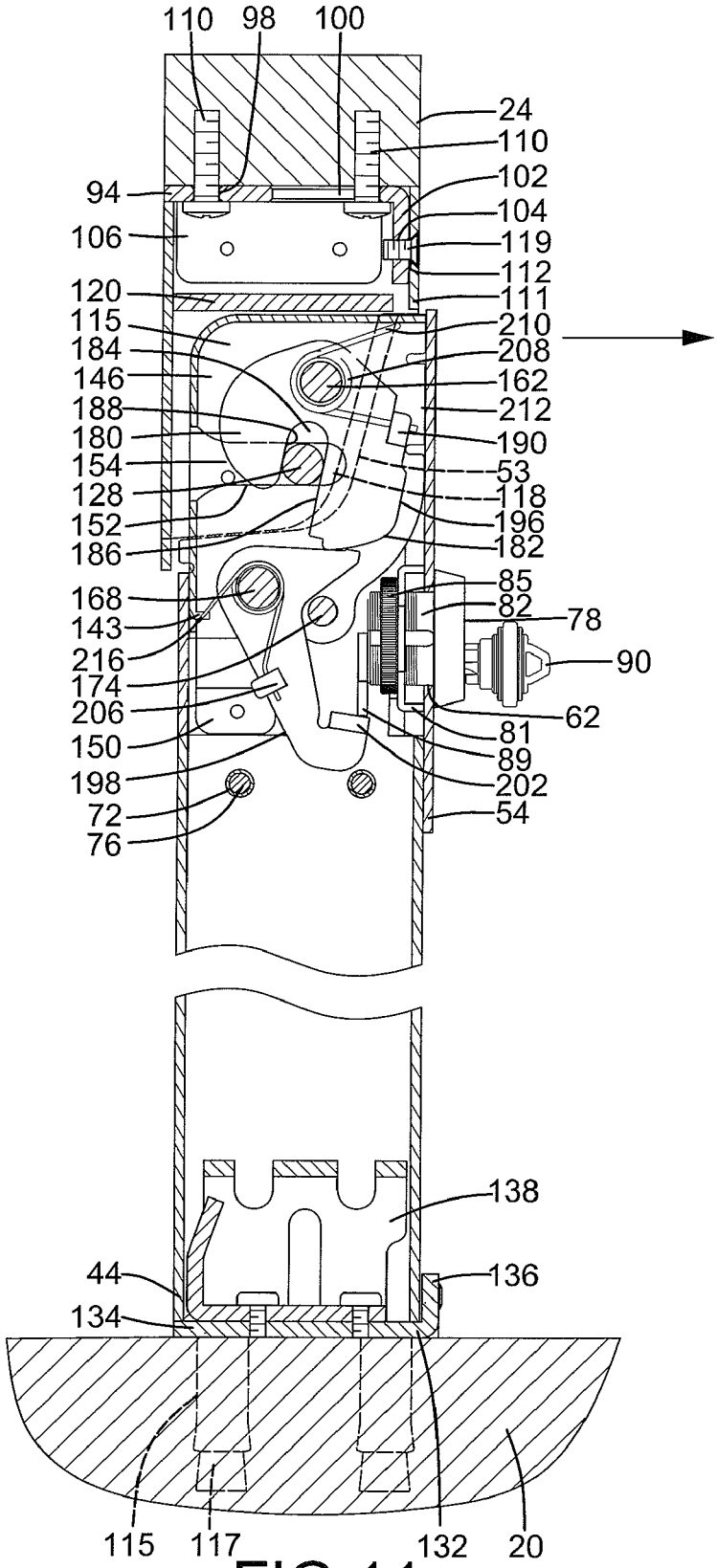
FIG. 11 shows a cross sectional view taken along section line 8-8 of FIG. 1 and similar to FIG. 10, with the post of the mullion assembly rotated in a direction away from the top mounting block.
Figure 12:
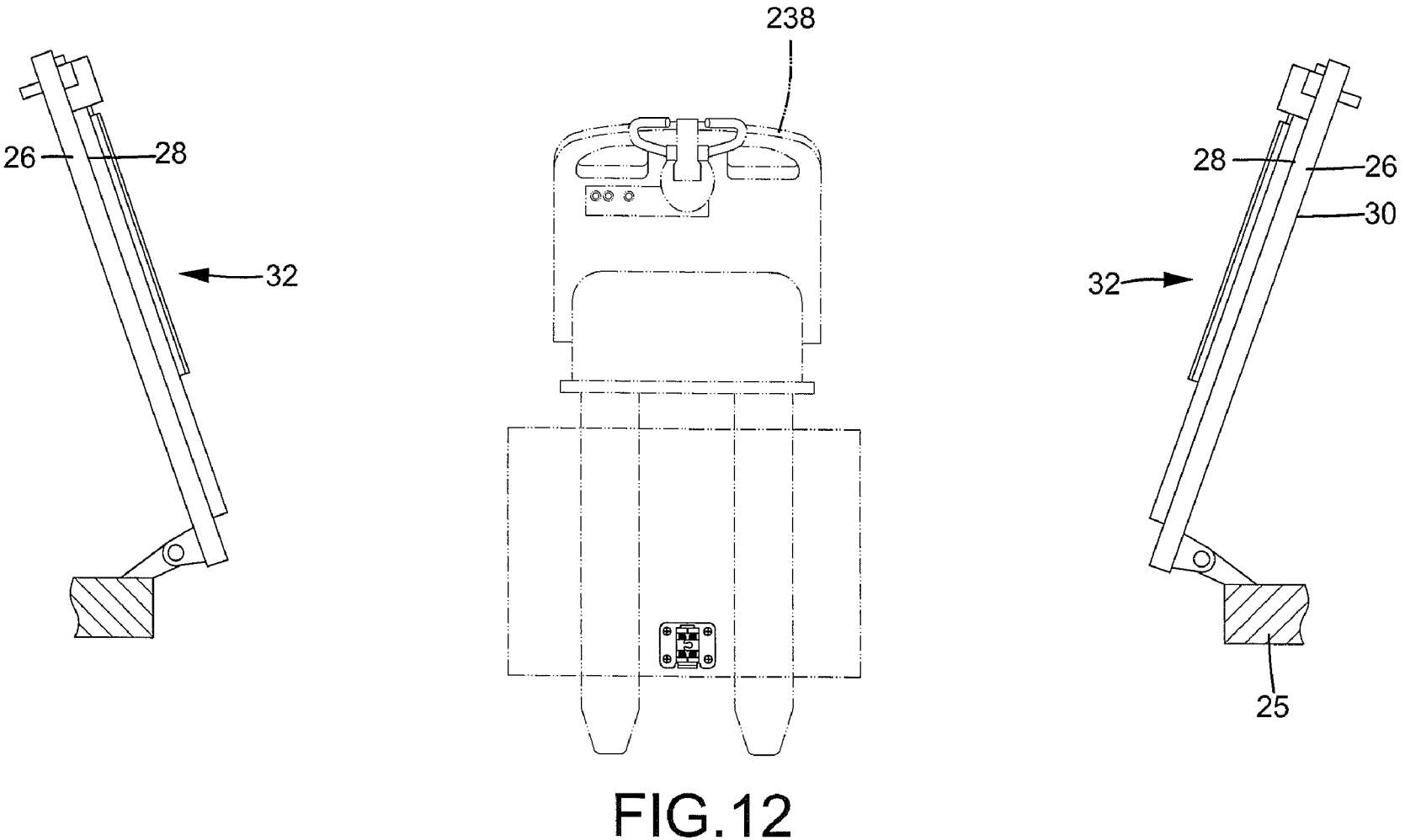
FIG. 12 shows a top view similar to FIG. 2, with two doors of the double door opened and with the post removed from top and bottom mounting blocks.

Mullion assembly 10 according to the preferred teachings of the present invention allows easy removal of post 40 from top and bottom mounting blocks 92 and 132. Namely, post 40 can be easily removed from top and bottom mounting blocks 92 and 132 by operating key cylinder 16. Specifically, when retaining member 198 is in the locking position and when key 90 is inserted into keyway 88 of lock core 86 and rotated (see FIG. 10), actuating member 89 is rotated to actuate abutting portion 202 of retaining member 198 so that locking portion 200 of retaining member 198 is moved downward from the locking position to the unlocking position disengaged from notch 192 of pivotal plate 180, allowing removal of post 40 from top and bottom mounting blocks 92 and 132. More specifically, when retaining member 198 is moved by actuating member 89 from the locking position to the unlocking position, pivotal plate 180 can be moved from the first position to the second position so that post 40 can be rotated in a reverse direction (see FIG. 11). When post 40 is rotated in the reverse direction, positioning rod 128 presses against second side 188 of coupling slot 184 to move pivotal plate 180 from the first position to the second position, allowing removal of positioning rod 128 from coupling slot 184 of pivotal plate 180 and allowing disengagement of post 40 from top and bottom mounting blocks 92 and 132. Referring to FIG. 12, after mullion assembly 10 is removed and doors 26 are opened, a full door opening is provided, allowing unobstructed pass for a pushcart 238.

Furthermore, mullion assembly 10 according to the preferred teachings of the present invention facilitates mounting of post 40 between top and bottom mounting blocks 92 and 132. Specifically, positioning rod 128 is received in coupling slot 184 of pivotal plate 180 during installation of post 40 without use of key 90 to move positioning rod 128, and positioning rod 128 will not be impinged during installation of post 40, because positioning rod 128 is not biased by a spring, allowing easy assembly of mullion assembly 10 without the risk of malfunctioning of positioning rod 128.

Now that the basic teachings of the present invention have been explained, many extensions and variations will be obvious to one having ordinary skill in the art. For example, guiding slots 152 of mounting bracket 140 can have a size greater than coupling slot 184 of pivotal plate 180.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims.

The invention claimed is:

1. A mullion assembly for a double door comprising, in combination:

a top mounting block adapted to be attached to a top beam of a door frame for a double door including first and second doors, with the door frame including two opposite side beams to which the first and second doors are pivotably mounted, with each of the first and second doors including a door lock having a latch, with the top mounting block including a positioning rod extending in a horizontal direction;

a bottom mounting block adapted to be mounted on a floor and spaced from the top mounting block in a vertical direction perpendicular to the horizontal direction;

a post including upper and lower ends spaced in the vertical direction, with the lower end of the post detachably engaged with the bottom mounting block, with the post further including two strikes adapted to respectively couple with the latches of the door locks when the first and second doors are in a closed state;

a brace mounted to the upper end of the post;

a mounting bracket mounted to the brace;

a pivotal plate pivotably mounted to the mounting bracket and including a coupling slot, with the positioning rod removably received in the coupling slot of the pivotal plate, with the pivotal plate being rotatable relative to the mounting bracket between a first position and a second position about a first pivot axis perpendicular to the vertical direction, with the pivotal plate being rotatable in a first direction and not rotatable in a second direction reverse to the first direction when the pivotal plate is in the first position;

a retaining member rotatably mounted to the mounting bracket about a second pivot axis perpendicular to the vertical direction and spaced from the first pivot axis in the vertical direction, with the retaining member including a locking portion and an engaging portion, with the locking portion of the retaining member being moveable between a locking position engaged with the pivotal plate and an unlocking position disengaged from the pivotal plate, with the retaining member being rotatable in the second direction and not rotatable in the first direction when the locking portion of the retaining member is in the locking position;

a stop extending through the mounting bracket in the horizontal direction, with the stop abutting against the retaining member to stop the retaining member from rotating in the first direction when the locking portion of the retaining member is in the locking position;

a key cylinder mounted to the brace and including a key-operable actuating member, with the actuating member being operably connected to the engaging portion of the retaining member to move the locking portion of the retaining member between the locking and unlocking positions, wherein when the pivotal plate is in the first position and the locking portion of the retaining member is in the locking position, the pivotal plate is not rotatable in either of the first and second directions from the first position to the second position, locking the post between the top and bottom mounting blocks, and wherein when the pivotal plate is in the first position and the locking portion of the retaining member is in the unlocking position, the pivotal plate is rotatable in the first direction from the first position to the second position, allowing removal of the post from the top and bottom mounting blocks.

2. The mullion assembly as claimed in claim 1, with the pivotal plate abutting against the brace and with the coupling slot of the pivotal plate substantially extending in the vertical direction when the pivotal plate is in the first position, with the pivotal plate abutting the mounting bracket and spaced from the brace and with the coupling slot of the pivotal plate being at an acute angle to the vertical direction when the pivotal plate is in the second position.

3. The mullion assembly as claimed in claim 2, with the mounting bracket being substantially U-shaped in cross section and including a main wall and two sidewalls interconnected by the main wall and spaced in the horizontal direction, with the mounting bracket further including upper and lower ends spaced in the vertical direction, with the two sidewalls of the mounting bracket including aligned guiding slots intermediate the upper and lower ends of the mounting bracket in the vertical direction and extending in a width direction perpendicular to the horizontal and vertical directions, with the main wall of the mounting bracket including an opening in communication with the guiding slots, and with the positioning rod removably received in the guiding slots of the two sidewalls of the mounting bracket.

4. The mullion assembly as claimed in claim 3, with the pivotal plate mounted between the two sidewalls of the mounting bracket, with the two sidewalls of the mounting bracket further including aligned first shaft holes, with the pivotal plate further including a second shaft hole aligned with the first shaft holes of the mounting bracket, with a shaft extending through the first shaft holes of the mounting bracket and the second shaft hole of the pivotal plate to allow the pivotal plate to rotate about the first pivot axis defined by the shaft between the first position and the second position, and with the positioning rod intermediate the shaft and the stop in the vertical direction.

5. The mullion assembly as claimed in claim 4, with the pivotal plate including upper and lower ends spaced in the vertical direction, with the second shaft hole of the pivotal plate intermediate the coupling slot and the upper end of the pivotal plate in the vertical direction, with the coupling slot extending from the lower end of the pivotal plate towards but spaced from the upper end of the pivotal plate, and with the lower end of the pivotal plate being rotatable relative to the mounting bracket about the first pivot axis between the first position and the second position.

6. The mullion assembly as claimed in claim 5, with each of the first shaft holes of the mounting bracket intermediate one of the guiding slots and the upper end of the mounting bracket in the vertical direction, with the two sidewalls of the mounting bracket further including aligned first pin holes each intermediate one of the guiding slots and the lower end of the mounting bracket in the vertical direction, with the retaining member further including upper and lower ends spaced in the vertical direction, with the locking portion formed on the upper end of the retaining member, with the engaging portion extending from the lower end of the retaining member away from the locking portion in the horizontal direction, with the retaining member further including a second pin hole aligned with the first pin holes of the mounting bracket, with a pin extending through the first pin holes of the mounting bracket and the second pin hole of the retaining member to allow the retaining member to rotate between the locking position and the unlocking position.

7. The mullion assembly as claimed in claim 6, with the retaining member having substantially V-shaped cross sections and including a substantially L-shaped side extending between the upper and lower ends of the retaining member, with the stop being a pin extending through the two sidewalls of the mounting bracket, with the stop abutting against the L-shaped side of the retaining member when the locking portion of the retaining member is in the locking position.

8. The mullion assembly as claimed in claim 7, further comprising, in combination:

a first torsion spring mounted between the two sidewalls of the mounting bracket and including a coil portion through which the shaft extends, with the first torsion spring further including first and second tangs extending from the coil portion and respectively abutting against the mounting bracket and the pivotal plate to bias the pivotal plate from the first position to the second position; and a second torsion spring mounted between the two sidewalls of the mounting bracket and including a coil portion through which the pin extends, with the second torsion spring further including first and second tangs extending from the coil portion of the second torsion spring and respectively abutting against the mounting bracket and the retaining member to bias the retaining member from the unlocking position to the locking position.

9. The mullion assembly as claimed in claim 8, with the brace including a first wall and second and third walls interconnected by the first wall, with the second and third walls of the brace spaced in the horizontal direction, with the brace further including upper and lower portions spaced in the vertical direction, with the lower portion of the brace fixed to the upper end of the post, with the key cylinder mounted on the first wall of the brace, and with the pivotal plate abutting against the first wall of the brace when the pivotal plate is in the first position.

10. The mullion assembly as claimed in claim 9, with the pivotal plate further including a notch in the lower end of the pivotal plate, with the locking portion of the retaining member engaged with the notch of the pivotal plate when the pivotal plate is in the first position and when the locking portion of the retaining member is in the locking position.

11. The mullion assembly as claimed in claim 9, with the top mounting block including an outer housing, with the outer housing including two side plates spaced in the horizontal direction and an interconnecting plate interconnecting the two side plates, with a receiving space defined between the two side plates and the interconnecting plate of the outer housing, with the positioning rod located in the receiving space of the outer housing, with a second opening formed in a lower end of the interconnecting plate, and with mounting bracket in the upper portion of the brace received in the receiving space of the outer housing through the second opening.

12. The mullion assembly as claimed in claim 11, with the top mounting block further including an upper cover attached to an upper end of the outer housing and adapted to be fixed to the top beam of the door frame, with the top mounting block further including an inner housing received and fixed in the outer housing, with the inner housing located below the upper cover in the vertical direction and including two side walls spaced in the horizontal direction, with the two side walls of the inner housing including aligned rod holes extending in the horizontal direction, and with the positioning rod including two ends spaced in the horizontal direction and respectively received in the two rod holes.

13. The mullion assembly as claimed in claim 12, with the bottom mounting block including a base having first and second sides spaced in the width direction, with a vertical wall extending upward from the first side of the base in the vertical direction, with a coupling block extending upward from the base in the vertical direction and between the second side of the base and the vertical wall in the width direction, with the lower end of the post engaged around the coupling block and resting on the base of the bottom mounting block, and with a portion of the lower end of the post sandwiched between the coupling block and the vertical wall of the bottom mounting block.

14. The mullion assembly as claimed in claim 9, with the bottom mounting block including a base having first and second sides spaced in the width direction, with a vertical wall extending upward from the first side of the base in the vertical direction, with a coupling block extending upward from the base in the vertical direction and between the second side of the base and the vertical wall in the width direction, with the lower end of the post engaged around the coupling block and resting on the base of the bottom mounting block, and with a portion of the lower end of the post sandwiched between the coupling block and the vertical wall of the bottom mounting block.

15. The mullion assembly as claimed in claim 7, with the brace including a first wall and second and third walls interconnected by the first wall, with the second and third walls of the brace spaced in the horizontal direction, with the brace further including upper and lower portions spaced in the vertical direction, with the lower portion of the brace fixed to the upper end of the post, with the key cylinder mounted on the first wall of the brace, and with the pivotal plate abutting against the first wall of the brace when the pivotal plate is in the first position.

* * * * *